US005750064A

United States Patent [19]

Uy

[11] Patent Number: 5,750,064

[45] Date of Patent: May 12, 1998

[54] DRY SPINNING PROCESS FOR PRODUCING ZEIN FIBERS

[75] Inventor: William Cheng Uy, Hockessin, Del.

[73] Assignee: E. I. du Pont de Nemours and Company, Wilmington, Del.

[21] Appl. No.: 783,725

[22] Filed: Jan. 16, 1997

Related U.S. Application Data

[60] Provisional application No. 60/010,261, Jan. 19, 1996.

[51] Int. Cl. [6] ..... D01F 4/00

[52] U.S. Cl. ..... 264/204

[58] Field of Search ..... 264/204

[56] References Cited

U.S. PATENT DOCUMENTS

| | | | |
|---|---|---|---|
| 2,156,929 | 5/1939 | Swallen | 264/202 |
| 2,211,961 | 8/1940 | Meigs | 264/202 X |
| 2,429,214 | 10/1947 | Biehn et al. | 264/202 |

OTHER PUBLICATIONS

Y. Yang et al., "Formaldehyde–Free Zein Fiber–Preparation and Investigation", J. of Applied Polymer Science, vol. 59, 433–441 (1996).

C. B. Croston et al., "Zein Fibers . . . Preparation by Wet Spinning", Industrial and Engineering Chemistry, vol. 37, No. 12, 1194–1198 (1945).

C.D. Evans et al., "Solvents for Zein, Primary Solvents", Industrial and Engineering Chemistry, vol. 33, 1416–1417 (1941).

R. H. Manley et al., "Binary Solvents for Zein", Industrial and Engineering Chemistry, vol. 35, No. 6, 661–665 (1943).

C. D. Evans et al., Ternary Solvents for Zein:, INdustrial and Engineering Chemistry, vol. 36, No. 5, 408–410 (1944).

*Primary Examiner*—Leo B. Tentoni

[57] ABSTRACT

The disclosed invention relates to a process wherein zein fibers are prepared by contacting zein with a volatile solvent system and dry spinning into a gaseous atmosphere. This process obviates the need for environmentally unfriendly alkaline solutions and acid coagulating baths.

12 Claims, 1 Drawing Sheet

DRY SPINNING PROCESS FOR PRODUCING ZEIN FIBERS

FIELD OF THE INVENTION

This application claims the priority benefit of U.S. Provisional Application 60/010,261, filed Jan. 19, 1996.

This invention relates to processes for making fibers from the corn protein, zein. This invention specifically relates to improved, environmentally friendly methods for making zein fibers.

BACKGROUND OF THE INVENTION

Current society's concern for the environment has created high interest in biodegradable polymers and in particular biopolymers, especially those that come from renewable agricultural resources. The abundance of corn grown in the United States alone and extensive wet-milling of corn make zein an attractive material for fiber development.

Zein is a naturally occurring polymeric protein and is similar to an aliphatic 2-nylon but with at least 20 different pendant groups. There are over 100 varieties of zein, but on the average, zein polymer contains 300 amino acids and has an average molecular weight of 30,000. Zein is a complex molecule and because it possesses these different pendant groups, it exhibits acidic, basic, polar and non-polar properties. Zein's major components are glutamine at 21%, leucine at 15%, proline at 13% and alanine at 11%. There is no regularity in the amino acid groups sequence in the zein molecule, thus preventing significant crystallinity formation.

Zein fiber possesses key properties of three natural fibers. Zein has the comfort of cotton, the warmth of wool, and the hand of silk. The material is advantageously biodegradable which makes it especially desirable given the current concern for our environment versus the non-biodegradability of synthetic fibers. Formaldehyde cured zein fiber is also resistant to acids, alkalis and most organic solvents. Zein fiber is not attacked by moths or insects that attack wool, and possesses outstanding aging properties.

Known zein fiber processes are highly polluting and complex, use low zein concentration (10%–20%) spin solutions which are highly unstable, and are wet-spun which severely limits spinning speed. Since zein is essentially a globular protein in its natural state and has a deficiency of hydrophilic groups, zein does not dissolve in water. Hence most known processes to make zein fibers employ an alkaline solution to initially hydrate and dissolve the zein, realigning it as desired (e.g., by wet spinning) and finally stabilizing the new alignment by inducing cross-linking. Most often the alkaline zein solution is wet spun into acidic coagulating baths. Some processes add formaldehyde to the alkaline zein solutions. After spinning, cross-linking can be induced by treatment in coagulating baths containing formaldehyde, and stabilizing with subsequent treatment with formaldehyde. C. B. Croston et al., describe such processing in "Zein Fibers . . . Preparation by Wet Spinning", Industrial and Engineering Chemistry, 37(12) (1945) 1194–1198. Croston et al. call for zein solutions for spinning containing approximately 13 to 16.5% solids, in the pH range of 11.3 to 12.7. In some experiments, denaturing or gelling agents, such as urea or alcohol were added, or denaturing was effected by applying heat. Formaldehyde was also used as an additive in the spinning dispersion. The resulting fibers went into a coagulating bath containing sulfuric acid, acetic acid and sometimes zinc sulfate, and were then treated with a mild formaldehyde curing bath. This curing bath was found to be necessary prior to the final stretching of the fiber tow which was accomplished in hot water between two variable speed reels.

In the 1940's, comprehensive studies were made in finding solvents for zein. These studies were published in the Industrial and Engineering Chemistry Journal in Vol. 33, November 1941 for primary solvents; in Vol. 35, June 1943 for binary solvents; and in Vol. 36, May 1944 for ternary solvents.

U.S. Pat. No. 2,211,961 describes a non-caustic 20% zein solution in 80% alcohol wet spun into a coagulating salt bath. In U.S. Pat. No. 2,429,214 the spin solution takes 2 hours to dissolve and once dissolved, it requires aging for a short time. The solution must then be used quickly because it will eventually denature into a gelatinous and unspinnable mass within 24 hours. Fiber formation consists of multiple steps: a coagulation stage, a long (16 hour) hardening and curing time in different baths, hot stretching in another different bath, re-immersion for hardening, washing, neutralizing and drying. All of the baths contain different salts and components that are consumed making maintenance of the composition a challenge.

U.S. Pat. No. 2,156,929 discloses the spinning of zein filaments in a variety of ways, including spinning a solution of zein into air or another gas and then evaporating the solvent. No mention is made of the solvent systems described herein.

Y. Yang, et al., J. Appl. Polym. Sci., vol. 59, p. 433–441 (1996) describes the spinning of zein fibers by various methods. Included in the studies reported in this paper is the spinning of zein fibers from an ethanol or isopropanol/water solution into air. Difficulties encountered in this method are described therein. No solvent systems such as are disclosed herein are described in this paper.

The environmental implications of such processes are a major prohibition to commercialization today. The expense of treatment and disposal of the acids, salts and organic compounds required in such processes make production of zein fibers economically impractical. The present invention is a more environmentally friendly and simpler process. The present invention uses 2× to 5× higher concentration of zein (>45%), dry spins and produces minimal wastes.

SUMMARY OF THE INVENTION

The present invention concerns a process for the dry spinning of zein fiber from solution, wherein the improvement comprises, using as a solvent a first component whose boiling point is about 0° C. to 50° C., and optionally a second component whose boiling point is greater than 50° C., provided that:

a starting weight fraction of zein in said solution is about 0.40 to about 0.60, based on the total amount of solvent and zein in said solution; and a weight fraction of said first component in said solution is $$S \geqq 1 - \frac{Z}{0.675}$$

wherein S is a starting weight fraction of said first component in said solution, and Z is said starting weight fraction of zein in said solution.

DETAILED DESCRIPTION

Figure 1:
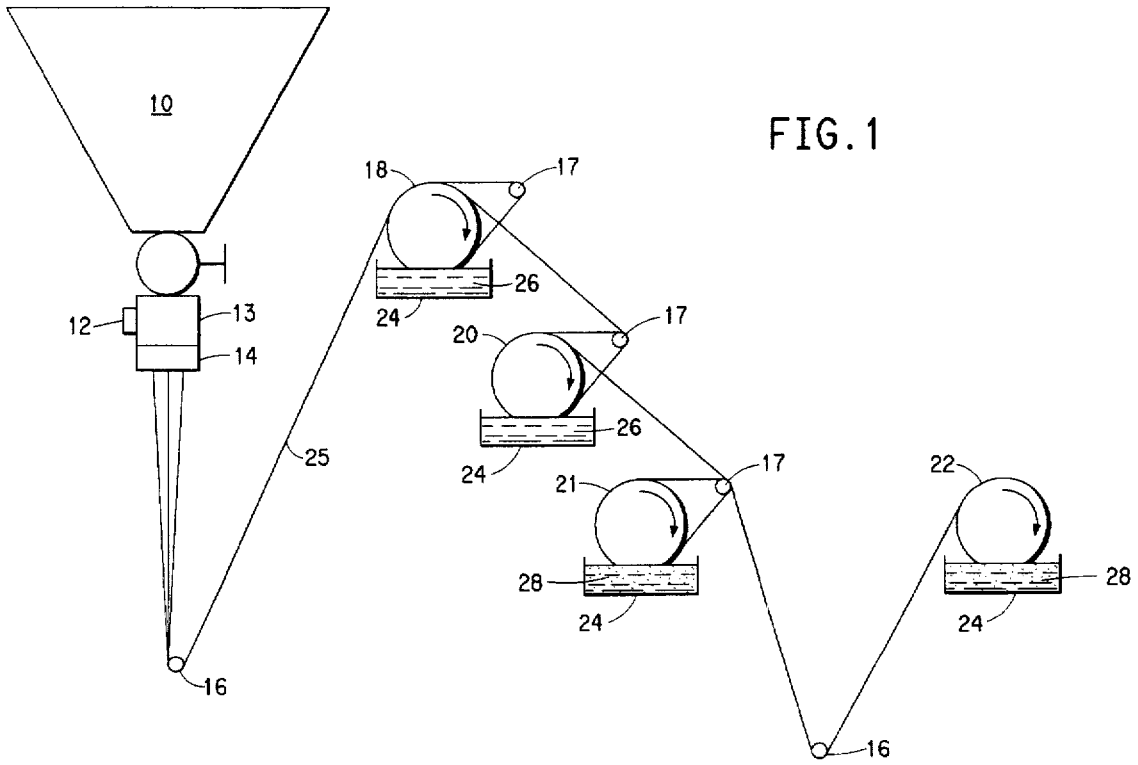
FIG. 1 is a process schematic of one embodiment of the present invention.

The process of the present invention provides a method for making zein fibers which avoids the alkaline solutions of zein and acidic coagulation baths of previous methods. In the process of the present invention, dry spinning is utilized, therefore there are no by-products to recover other than volatile solvents.

The process of the present invention involves contacting zein with a solvent system to form a solution. By "zein" is meant the naturally occurring polymeric protein obtained from corn.

By the weight fraction of zein in solution is meant the weight of zein in the solution divided by the total weight of zein plus the solvent system (including the first and second components of the solvent system). By weight fraction of first (more volatile) component is meant the weight of the first component divided by the total weight of the zein plus the solvent system (including the first and second components of the solvent system).

By solvent system is meant one or more solvents, alone or together being a solvent for zein, at least one of whose components has a boiling point (at atmospheric pressure)of about 0° C. to 50° C. A wet spinning process is difficult to make environmentally friendly and possesses an inherent limitation in spinning speed. In order to have a dry spinning process, a suitable volatile solvent system must be selected. It is difficult to identify any one solvent because zein is such a complex protein molecule with its many non-repetitive amino acid sequences. Therefore, the first component (above) alone can be, but need not be, a solvent for zein but must be capable of forming a solvent system for zein when in contact with one or more other components of the solvent system.

In dry spinning, it is preferable that at least part of the solvent system selected evaporates quickly. The boiling point temperature of the first component of the solvent system preferably ranges from about 5° C. to about 45° C.

The first component of the solvent system may be one or more of methylene chloride (MeCl), acetaldehyde (AA), ethylamine, furan, propylene oxide, ethyl mercaptan, methyl iodide, and propionaldehyde. MeCl and AA are preferred and MeCl is more preferred. Preferably the weight fraction of the first component of the solvent is $$S \geqq 1 - \frac{Z}{0.700}$$

wherein S and Z are as defined above.

The second component of the solvent system may be optionally present. The minimum weight fraction of the first (more volatile) component is given above, and the first component may be the entire solvent system. However, a less volatile component may also be present, and in some cases may be desirable and/or necessary. Some of the compounds listed above are not in fact solvents for zein, but must be mixed with another compound to form the necessary solvent system. The other compound in this case may be a less volatile compound, i.e., the second component. It may be desirable to have a plasticizer in the spinning solution so the resulting fiber is plasticized. The plasticizer may be part of the solvent system, and it is not a volatile material, would be part of the second component which does not volatilize at all. Compounds suitable as the second component include, but are not limited to, one or more of methanol (MeOH), ethanol (EtOH), acetyl chloride, water, diethylamine, acetone and hexafluoroisopropanol. Water, methanol and ethanol are preferred, and methanol and ethanol are more preferred.

A preferred combination of components for the solvent system is methylene chloride or acetaldehyde for the first (relatively volatile) component and methanol or ethanol for the second (relatively nonvolatile) component. Since zein is not soluble in methylene chloride alone, a cosolvent is needed. For instance, when the first component is methylene chloride and the second component is methanol (or ethanol), the weight proportions of the solvent itself may be about 50% by weight of methylene chloride to about 50% by weight of methanol (or ethanol) ranging to about 80% by weight of methylene chloride to about 20% by weight of methanol (or ethanol), or when the first component is acetaldehyde and the second component is methanol (or ethanol), the proportions of the solvent itself may be about 60% by weight of acetaldehyde to 40% by weight of methanol (or ethanol). Most preferably, the first component is 60 weight % methylene chloride and the second component is 40 weight % methanol.

Table 1 below shows at constant 0.45 weight fraction zein, the actaldehyde/methanol solvents weight ratio, solution stability, fiber forming capability and solution clarity of acetaldehyde with methanol as a co-solvent. Increasing the acetaldehyde to methanol ratio from 60%/40% decreases solution stability and solution quality. A small amount of water can improve solution quality but may shorten stability. Table 2 below shows methylene chloride with first ethanol and then methanol used as the co-solvent (weight ratios shown). The solution stability is several times better with methanol than with ethanol. Optimum solution quality as judged by solution clarity occurs at about a 60%/40% methylene chloride/methanol (a weight ratio of about 1.5:1) composition. Solution stability time can also increase with decreasing zein concentration. However, solutions tend not to be thread-forming at 40% or lower concentration.

TABLE 1

Acetaldehyde/methanol solvent (acetaldehyde b.p. = 21° C.; 2.0 g sample size)

| % Zein Solution | AA/MeOH Solvents Ratio | Solution Stability | Fiber Forming | Solution Clarity |
|---|---|---|---|---|
| 45 | 60/40 | >11–18 days | Yes | Hint of haziness |
| 45 | 75/25 | >2–7 days | Yes | Very slight haziness |
| 45 | 80/20 | <<0.5 day | Yes | Opaque to slight haziness |
| | AA/MeOH/$H_2O$ | | | |
| 45 | 75/20/5 | >2 days | Yes | Least hazy |
| 45 | 80/15/5 | <1 hour | No | Slight haziness |

TABLE 2

Methylene Chloride/Methanol Solvent (methylene chloride b.p. = 40° C.; 2.0 g sample size)

| % Zein Solution | Solvents Ratio | Solution Stability | Fiber Forming | Solution Clarity |
|---|---|---|---|---|
| | MeCl/EtOH | | | |
| 55 | 70/30 | <10 min | Gelled fast | Hazy |
| | MeCl/MeOH | | | |
| 55 | 70/30 | 1 hr 20 min | Yes | Opaque yellow |
| 50 | 70/30 | >5–20 h | Yes | Less hazy |

TABLE 2-continued

Methylene Chloride/Methanol Solvent (methylene chloride b.p. = 40° C.; 2.0 g sample size)

| % Zein Solution | Solvents Ratio | Solution Stability | Fiber Forming | Solution Clarity |
|---|---|---|---|---|
| 45 | 70/30 | 22 h | Yes | Clearer |
| 45 | 80/20 | 11 h | Yes | Hazier than 70/30 |
| 45 | 65/35 | >18 h | Yes | Slightly hazy |
| 45 | 60/40 | 13–23 h | Yes | Transparent |
| 45 | 50/50 | — | Poor | Hazy |
| 55 | 60/40 | <3 h | Yes | Transparent |
| 40 | 60/40 | 24–48 h | No | Transparent |

One method of contacting the zein with the solvent system is by mixing which can be performed with a stirring rod, or by using a conventional mixing apparatus. A blade peripheral speed of 5 to 20 meters/minute against a stationary surface works well. The zein particles should be dispersed quickly and dissolved, preferably within 10 minutes, otherwise localized high concentration can speed up gelation. However, too high shear mixing can generate localized heating which contributes to rapid gelation. Preferably, the zein is added into a premixed solvent system. Process conditions are simple because both dissolving and dry spinning can be done at ambient conditions. Anti-stats and plasticizers can be added to prevent ballooning of the fibers due to static and to improve drawability. Preferably, contact of the zein with the solvent system is made at a temperature ranging from about 18° C. to 25° C. If the temperature is too cold, the zein will not go into solution, and if the temperature is too warm, the solution gels too quickly.

A high solution concentration is preferably used in order for extrusion to proceed cleanly. A preferred weight fraction of zein for spinning is about 0.45 to about 0.60. There are many solvents that will dissolve zein; however, at a concentration high enough to be fiber forming, some solutions gel quickly. Zein, like all natural proteins, tends to denature when in solution at spinnable concentration. Denaturing turns a spinnable solution into a gel-like, semi-solid thereby losing its thread-forming characteristics. For example, methanol is a solvent for zein in a solution comprising about 55 weight % zein, however, this solution lasts only about 10 minutes before turning into a gel. Another common and inexpensive solvent is acetone. In pure form, acetone is not a solvent for zein but as a binary solvent with water is an excellent solvent. In a 55 weight % zein solution wherein the solvent system is the acetone/water binary solvent having a 60/40 weight % ratio, stability of the solution is only 5 hours, and in a 60 weight % zein solution using the same binary solvent, stability of the solution lasts only 3.4 hours. Preferably, the solvent system will form a spinnable solution that is stable for at least 12 hours. Most preferably the zein comprises 45% to 60% by weight of the solution. Below 45 weight percent, and especially below 40 weight % zein the solution can become a sticky mess, and above 60%, the solution can denature or gel quickly into a non-fiber forming elastic gel.

Dry spinning is a well-known technique in the art for forming fibers, see for instance H. Mark, et al., Ed., Encyclopedia of Polymer Science and Engineering, vol. 6, John Wiley & Sons, New York, 1986, p. 802–839, which is hereby included by reference.

The present process is a conventional dry spinning process, and involves extruding the zein solution into a gaseous atmosphere to form the zein fibers. Zein does not melt and therefore cannot be melt spun; it must be spun from solution. Therefore, there is a need to increase concentration to make spinnable solutions. Fiber formation is accomplished in the present invention by dry spinning whereby the zein solution is extruded through a standard spinneret commonly used in the industry. The spinneret can contain one or a plurality of orifices as the number of orifices in the spinneret has little effect except on the rate of fiber production. Preferably, the spinneret hole diameter is about 0.13 mm. The solution can first pass through a filtering medium, such as a Dynalloy® fiber metal filter, available from Fluid Dynamics, Deland, Fla., prior to extrusion through the spinneret into a gaseous atmosphere, such as ambient air or air at elevated temperatures if higher boiling point solvents are used. Rapid evaporation of the solvent system consolidates the extruded solution into solid fibers. Therefore, there is preferably a long distance between the spinnerets and a change-of-direction roll to allow evaporation of the volatile solvents(s) before reaching the change-of-direction roll. The fibers can then be wound up on a bobbin using a winding machine, such as a Leesona® available from Leesona Corp., Warwick, R.I., or they can be further processed in-line.

By "fibers", as used herein, is meant filaments, fibers, yarns, and threads of any denier or cross-sectional shape and bands or tows consisting of any number of such filamentary articles.

In-line or post-processing the fiber can improve fiber tensile properties and reduce sensitivity to water. Therefore, the present process can optionally and preferably further comprise one or more of the following steps performed one or more times: contacting the fibers with water, drawing the fibers, contacting the fibers with a stabilizing solution, contacting the fibers with a salt solution, and hot drawing the stabilized fibers.

After spinning and drying the zein fibers may be contacted with water or an aqueous stabilizing solution comprising a cross-linking agent prior to drawing to wet the fibers. Since the stabilizing solution is aqueous based, preferably the stabilizing solution is used to wet the fibers. If the volatile solvent(s) have not evaporated, the extruded solution would partially dissolve upon contact with water or the aqueous stabilizing solution and form a sticky mass. Therefore, it is important that most of the volatile solvent(s) evaporate prior to the fibers contact with water or the aqueous stabilizing solution. Water acts to soften the fiber. Softened fiber has a natural tendency to elongate which facilitates drawing. The fiber without the water or aqueous stabilizing solution soaking has no propensity for draw and will break rather than draw at ambient temperature. However, in an embodiment wherein the zein solution further comprises urea, it is not necessary to contact the fibers with water or the stabilizing solution prior to drawing. Urea in the extruded fiber facilitates drawing.

Contacting the zein fibers with the aqueous stabilizing solution will also wet the fibers, and the water in the solution will facilitate drawing. Due to the lack of regularity in its molecule, zein is incapable of forming any significant crystallinity to stabilize its molecular structure. All important commercial fibers have some crystallinity which render the fibers stronger and more resistant to temperature and solvents. Due to the lack of significant crystallinity, zein fibers should be stabilized otherwise they will melt in the presence of water at only 50° C. Extruding the solution into a gaseous atmosphere effectively orients the zein molecules. Once oriented, the fiber can then be stabilized by covalent cross-linking. Cross-linking is accomplished by treating the fibers with a stabilizing solution, or optionally with a salt solution comprising a cross-linking agent further described below.

for a time sufficient to effect stabilization. By "stabilizing solution" is meant an aqueous solution comprising a cross-linking agent. By "cross-linking agent" is meant any material with which zein is contacted that will cause the zein to become cross-linked. By "cross-linked zein" is meant a physical state of zein which will not melt when exposed to hot water. Preferably the stabilizing solution comprises formaldehyde as the cross-linking agent. High concentration formaldehyde solution in water is a solvent for zein, therefore, the stabilizing solution is generally a few percent, e.g., 1–5%, preferably 3% in concentration. The formaldehyde which can be employed in the stabilizing solution of the present invention can be added to the stabilizing solution as such, or it can be added in the form of materials which yield formaldehyde or react like formaldehyde under the conditions obtained in such stabilizing solutions. For instance, instead of formaldehyde itself, paraformaldehyde, trioxymethylene, dimethylthiourea, trimethylolnitromethane and the like can be used.

The fiber is immersed in the stabilizing solution and/or in the salt solution comprising the cross-linking agent for a time period sufficient to effect stabilization. Though the stabilization time period will depend on the concentration of crosslinking agent in the stabilizing solution and/or the salt solution comprising the cross-linking agent, temperature can also be a factor. For example, exposure of the fibers to the stabilizing solution and/or to the salt solution comprising the cross-linking agent, should be at least about 2 hours when at ambient temperature using formaldehyde as the cross-linking agent. With in-line processing, the fiber can be passed onto a take-up roll, partly submerged in the stabilizing solution and/or the salt solution comprising the cross-linking agent, or sprayed with a stream of stabilizing solution and/or salt solution comprising the cross-linking agent. If the fiber has already been collected on a bobbin, the bobbin can be taken off-line and rewound passing it through the stabilizing solution and/or through the salt solution comprising the cross-linking agent.

The zein fibers may also be drawn. The fibers can be drawn prior to, during, and/or after contact with the stabilizing solution to maximize the tensile properties. Although the cross-linking agent is not required for drawing, water is needed to soften the fiber. However, since the cross-linking agent is eventually needed to stabilize the fibers, the fibers are preferably contacted with the stabilizing solution prior to and/or during drawing. By "drawing" it is meant any stretching of fiber to align and further orient the zein molecules in order to achieve improved tensile properties. Preferably, there is at least one drawing step after fiber formation to achieve the best tensile properties, to make the fiber ductile, and/or to reduce denier. If the drawing step is accomplished prior to contact with the stabilizing solution, drawing should be done in water at ambient temperature, since higher temperatures can melt the fibers. Although the fibers would draw or lengthen at temperatures at or above their melting temperature, they would not achieve molecular orientation. Preferably, a draw ratio greater than about 2 is realized. Higher temperatures, up to about the boiling point of water can be used for drawing after contact with the stabilizing solution for a period of time sufficient to effect stabilization since the fibers will not melt at this point. Drawing at later stages after stabilization is effected can be performed at temperatures exceeding the boiling point of water.

Drawing is preferably accomplished during and/or after treatment in the stabilizing solution. Therefore, optionally contacting the drawn fibers with the stabilizing solution during and/or after drawing may be carried out. Preferably contact with the stabilizing solution is made during and/or after each draw except for the final draw prior to stabilization. At the final draw the fibers are contacted with a salt solution as described below.

By draw ratio is meant the amount by which the fibers are stretched following extrusion. Generally, the draw ratio is set by controlling the ratio of speeds between a feed-roll and a draw-roll of a drawing system. Continuous fibers from a bobbin are wrapped around the feed-roll, may pass over a hot pin or other heating device or hot bath, and are wrapped around the draw-roll, which turns faster than the feed-roll. The ratio of the draw-roll to the feed-roll is the amount of draw or stretching on the fiber.

It is preferred that a two stage draw is used. Minimal number of wraps is used on the feed-roll so that the last wrap just begins to sag. The softened fiber elongates and is drawn between the feed-roll and a first draw-roll. The first draw-roll is run at a faster speed to draw the fiber and take out the sag. Sagging will occur at a shorter time than the treatment time required in the stabilizing solution before the fiber's full draw ratio potential is produced by the solution. Severe sagging can cause wraps overlapping and breakdown. The fiber is further drawn between the first draw-roll and a second draw-roll. The second draw-roll draws the fibers to near their maximum potential. The total maximum draw is accomplished in two draw stages because maximum draw does not occur in the first draw since the fiber does not have enough contact time with the stabilizing solution. Too many wraps on the feed-roll to increase contact time does not solve the problem because the fiber tends to elongate and sag, thereby causing break downs.

Immersion of zein fibers in the stabilizing solution causes the fiber to become partly tacky. Therefore, the fibers can be treated with a salt solution to prevent sticking. Thus, the drawn fibers may be contacted with a salt solution, preferably during and/or after the final draw prior to stabilization. The salt solution comprises a salt, such as sodium sulfate or sodium chloride, and preferably comprises the same ingredients as disclosed above for the stabilizing solution but with the salt added. The concentration of sodium sulfate can range as high as 20% by weight. Sodium chloride tends to provide more desirable properties than sodium sulfate and a lesser amount can be used. Formaldehyde content of the salt solution can be as low as 1% by weight or as high as 5%; preferably, it is 3%.

Salt is not included in the stabilizing solution described above because salt impedes drawability. Therefore, contact with the salt solution should not be made prior to the final draw before stabilization of the fibers. The wet and drawn fiber can be wound on a bobbin in an enclosed environment to prevent drying with the bobbin submerged or sprayed with the salt solution. Preferably stabilization will occur during contact of the fibers with a salt solution comprising a cross-linking agent after the final draw. A minimum time for effecting stabilization is about 2 hours at ambient conditions using formaldehyde, but preferably the fibers are contacted with the stabilizing solution or the salt solution containing the crosslinking agent about 8 hours to effect stabilization. Subsequent immersion of the fibers in a fresh water bath removes the salt. Drawing of the fiber imparts ductility. Therefore, if the as-spun fibers are wound up directly without drawing and are contacted with the salt solution, the stabilized fibers will be brittle.

Multiple-stage drawing systems are contemplated as a way to further increase tensile properties. Thus, hot drawing the stabilized zein fibers at least once; and contacting the hot drawn fibers with the salt solution, described above, may be carried out. At a first stage of drawing as described above, the fibers are drawn to preferably 2× their length which acts to take out their natural tendency to elongate and are therefore tightly wound. At a second stage of drawing, the fibers can be fully drawn out 3× to 6× their length. After the fibers are stabilized, a hot stage draw using heated rolls can be used to obtain 2 grams/denier (gpd) in tenacity.

The tenacity of as-spun fiber is generally 0.3 gpd while stabilized and drawn fiber appears to level at 0.7–0.8 gpd. Evidence indicates that this limiting property may be due to the alpha-helical structure of the zein molecules as a result of extensive intramolecular hydrogen bonding. Zein solution further comprising a chaotropic agent can be used to disrupt the hydrogen bonding although many chaotropic agents are not soluble in the preferred methylene chloride/methanol volatile solvent system of the present invention. Urea is an effective and soluble chaotropic agent, even though, it also has the effect of shortening the zein solution spin stability time. The amount of solid urea that can be used is at the maximum limit of solubility in, for example, a 60%/40% methylene chloride/methanol solvent. However, in the presence of zein, more urea may be soluble. When urea is one of the ingredients of the zein solution, it is not necessary to wet the fibers prior to drawing. Urea in the extruded fiber facilitates drawing. Once drawn to the desired length, these fibers can be simply contacted with the salt solution comprising a cross-linking agent for a time sufficient to effect stabilization. It is necessary that the salt solution contain the cross-linking agent if the fibers have had no previous contact with the stabilizing solution.

The response of the zein fibers to hot drawing was found herein to be uniquely different and unpredictable versus simpler polymers like nylon 6,6 or polyethylene terephthalate. Through optimization of the drawing process and with urea as a Chaotropic agent, a fiber tenacity as high as 2.05 gpd or a 15-filament yarn denier/tenacity/elongation/modulus (D/T/E/M) of 42 denier/2.05 gpd/10%/58 gpd with a total draw ratio of 9.75 was realized. This tenacity exceeds the "VICARA" protein fiber value of 1.2 to 1.5 gpd and is just slightly lower than 2.17 gpd, the highest tenacity for zein ever reported.

The effects of draw temperature on fiber tenacity was studied over the range of 100° to 265° C. at increments of 10° C. At a constant draw ratio, yarn tenacity was optimized at the following temperatures: 110°, 150° and 210° C. The hot-shoe contact length was found to be inversely proportional to the draw temperature. At 210° C., the full meter contact length is required. But at 150° C., contact length is shortened to about half, and at 110° C., contact length is about 1 to 2 inches otherwise the running threadline will break due to fiber becoming soft and tacky and sticking to the hot shoe.

Water is a drawing-aid plasticizer. It increases draw ratio and also improves the fiber toughness.

The gain in tenacity per draw should be locked prior to succeeding wet draw otherwise the gain is lost apparently due to molecular relaxation in the presence of water. Locking is done by contacting the drawn yarn in a stabilizing solution containing salt, for example, an aqueous solution comprising 3% formaldehyde and 7.6% sodium chloride.

The present invention can be used in both a continuous and batch process. In a continuous process embodiment, continuous feed of the zein and volatile solvents can be made to, for example, a twin screw extruder. Another embodiment of the present process is shown in FIG. 1. This design is for a batch process and includes metering pump block (12 and 13) attached to mixer (10), such as an Atlantic Mixer, available from Design Integrated Technology, Warrenton, Va., so that solution can be made and spun directly from mixer (10). Pump block (13) can be used with standard metering pump (12), such as a Zenith metering pump available from Zenith Products Co., West Newton, Mass., which is driven by a removable spring loaded shaft powered by a motor, such as a 1 horsepower Reliance motor through a Boston 300 Series step-down gear, available from Boston Gear Division, IMO Industries, Inc., Quincy, Mass. Filter pack and spinneret (14) are followed by a first change-of-direction roll (16). A two stage in-line draw is shown which consists of 1 feed-roll (18), two draw rolls (20 and 21), and windup (22), such as a Leesona®. The feed-roll and each draw-roll has an accompanying idler roll (17) and feed-roll (18), draw rolls (20 and 21) and windup (22) have immersion trough (24). A second change-of-direction roll (16) is found between second draw-roll (21) and windup (22). The fiber (25) is shown immersed in immersion trough (24) filled with stabilizing solution (26) for feed-roll (18) and first stage draw-roll (20). The fiber is shown immersed in immersion trough (24) filled with salt solution (28) for second stage draw-roll (21) and windup (22).

The fibers prepared by the process of the present invention are useful in the manufacture of textile materials, for example, in fabrics used for clothing and industrial end uses.

EXAMPLES

Zein was obtained from Freeman Industries, Inc., Tuckahoe, N.Y.

In the Examples all percentages are by weight.

Comparative Example 1

A two-gram solution was prepared in a sealed vial containing 55% zein, 27% ethyl alcohol, 18% water for a 60%/40% solvent ratio. A glass stirrer, inserted through a small diameter hole in the rubber seal, provided the means for mixing. After complete dissolution in 6 to 10 minutes, the rubber seal was removed and the vial was covered with a screw-on cap to prevent loss of solvent. Fiber samples were hand pulled from the solution using fine point tweezers.

Hand-pulled filaments were found to have no strength, like soft gel and sticky, indicative of too slow a drying rate for dry spinning.

Comparative Example 2

A two-gram solution was similarly prepared as in Comparative Example 1 except that the zein concentration was increased to 60% and the ethyl alcohol to water ratio was increased to 70%/30%. Hand-pulled filaments were found to still dry too slowly for dry spinning.

Comparative Example 3

A two-gram solution was similarly prepared as in Comparative Example 2 except that the solvent ratio was increased to 80%/20%. Hand-pulled filaments appeared to dry fast enough resulting in a gutsy fiber.

Comparative Example 4

Based upon the results of Comparative Example 3, a 120-gram spinning solution with the same composition as in Comparative Example 3 was prepared in the same manner as in Example 2 (below).

Using a 0.127 mm dia., 15 hole, spinneret, filaments jetted out from the spinneret holes at 2.1 m/min. However, the filaments were gel-like, appeared sticky, and had no SSF (Spin Stretch Factor), that is, they broke from the spinneret face as soon as they were pulled by the take-up roll at a speed faster than the jet velocity. After increasing throughput to a jet velocity of 4.2 m/min, the filaments became stuck together indicating that the drying rate was too slow.

Comparative Example 5

In order to speed up the drying of the filaments, half of the ethanol of Comparative Example 4 was replaced with acetone (b.p. 56.5° C. vs. 78.5° C. for ethanol). Acetone, by itself, is not a solvent for zein. Although acetone with water is a solvent for zein, at spinnable solution concentration, such a solution denatures too rapidly and, therefore, too unstable for spinning. Increasing the content of water slows down the gelation rate, however, this seriously affects the volatility rate.

A 120-gram spinning solution was prepared containing 55% zein, 20.3% acetone, 20.3% ethanol, and 4.5% water for a 45%/45%/10% solvent ratio.

Using a 0.127 mm hole, 15 hole, spinneret, filaments jetted out from the spinneret at 2.1 m/min. The filaments had no SSF. The free-fall and air-dried filaments were brittle. The pack pressure was also exceedingly high at 3.8 MPa for a throughput of only 0.027 ml/min per hole.

Example 1

A spinning solution of zein is made by adding zein into a premixed solvent containing methylene chloride and methanol, preferably in the weight ratio of 60% methylene chloride to 40% methanol. The solution concentration is preferably 45% to 50%. The preferred mixing conditions are 18° C. to 25° C. at a mixing blade peripheral speed of 5 to 20 meters/minute against a stationary surface.

Filaments are formed by forcing the solution through a filtering medium and through a spinneret into ambient air. The rapid evaporation of the solvents consolidate the extruded solution into solid filaments. The yarn can then be wound up on a bobbin using a winding machine such as a Leesona® or it can be farther processed in-line.

With in-line processing, the yarn is passed onto a take-up roll, partly submerged in a cross-linking solution or sprayed with a stream of cross-linking solution. This is followed by a similarly set-up first draw-roll, then to a similarly set-up second draw-roll except that the solution also contains a salt. The wet and stretched yarn is then wound up on a bobbin in an enclosed environment to prevent drying or the bobbin is partially submerged in a formaldehyde/salt solution or the solution is sprayed onto the bobbin during windup. A minimal number of wraps is used on the take-up roll so that the last wrap just begins to sag. The first draw-roll is run at a faster speed to draw the fiber and take out the sag. The second draw-roll draws the yarn to near its maximum potential. The bobbin of yarn is then kept submerged in a similar formaldehyde/salt solution to crosslink the zein molecules. The bobbin of cured yarn is removed from the immersion bath and immersed in a fresh water bath and final rinsing is done following the same rolls set-up as the in-line processing except that fresh water is used.

Example 2

A solution (120 g) at 45% zein concentration containing 54 grams of zein in a 60%/40% methylene chloride/methanol solvent was prepared at 22° C. in a 2 c.v. Atlantic Mixer. The solution was prepared under closed vacuum to remove air bubbles and to prevent excessive loss of the highly volatile methylene chloride. The vacuum valve was opened gradually right after polymer addition to prevent boiling over and then shut off after equilibrium pressure had been reached. During the 30 min mixing time, the vacuum valve was briefly opened about 2 more times and then shut off once equilibrium pressure was reached. The solution exhibited excellent fiber-forming characteristics.

Excellent spinning continuity was achieved from beginning to end using a 0.127 mm dia., 15 hole, spinneret at spin-stretch factor of 1.0 to 2.0 at speeds up to 34 m/min. The only problem encountered was static at the slow spinning speed of 1 to 3 m/min when most of the solvents had evaporated and the air humidity was low. Filaments had a glittering look and round particles were observed under microscope due to the impurities found in the Freeman's zein.

To combat the static problem encountered in the previous spin, propylene glycol was added and comprised 3.1% in the solution but still maintained the 60%/40% methylene chloride/methanol solvent ratio. Spinning quality was enhanced. With jet velocity maintained at 2.0 m/min, the take-up roll speed was increased and bobbins of yarn collected at a spin-stretch factor (SSF) of 1 to 6. Maximum SSF was 11, beyond which break down occurred. The necking phenomenon was observed in a few filaments. However, some ballooning was still observed due to static. Because there was already some partial sticking of the filaments, additional propylene glycol was not added, which constituted 5.4% in the fiber after the volatile solvents had evaporated. Fiber tensile properties remained essentially the same regardless of the degree of SSF: T/E/M (tensile strength/Elongation/tensile modulus) of 0.28–0.30 gpd/3.2%-2.0%/18–20 gpd for SSF of 1 to 6.

The yarns wound up without any draw except for the spin-stretch, were relatively brittle. However, a slight draw was enough to toughen the yarn considerably. The yarns spun from this solution at SSF=5 could be drawn in-line only 1.2×. Therefore, the dried yarn was drawn off-line at elevated temperatures. At a constant feed speed of 2 m/min, the yarn was drawn 1.5× at 90° C. and the draw ratio increased to 3.2× at 140° C. Drawing increased the tenacity and modulus slightly but not in proportion to the degree of draw, e.g., at the maximum draw of 3.2×, the tenacity and modulus were 0.53 gpd and 23 gpd, respectively. Yarn break elongation, however, improved an order of magnitude to 26%.

Example 3

A solution (1,200 g) at 50.1% zein concentration was prepared using a 60%/40% methylene chloride/methanol ratio and containing a small amount of polyethylene glycol (200 molecular weight) for anti-static protection and water for draw assist. The solution was prepared in one hour.

Using a 0.127 mm dia., 40 hole, spinneret, all 40 filaments jetted perfectly at 3.5 m/min from the spinneret and free falling to the first change-of-direction roll for a distance of 38 inches. The yarn was then strung up by a take-up roll at 7.0 m/min for a 2.0 SSF. The yarn could not be drawn in-line at room temperature, but was still sufficiently ductile to be wound up on a bobbin.

With the take-up roll and subsequent draw-rolls immersed in a solution containing 3% formaldehyde and 15% sodium sulfate or 7.5% sodium chloride, the yarn was easily drawn 3× in two stages with the first stage draw at 2× and 1.5× on the second stage draw. While the completely soaked yarn can be drawn 3×, it cannot be done in one stage for the following reasons. The yarn tended to grow in length when wet and as a result, the yarn no longer wrapped around the draw-roll and idler roll tightly but tended to sag. Since it took several wraps to achieve the desired time to soak through, the sagging would become excessive such that the wraps would overlap and caused a breakdown. This problem was overcome by using only 2 wraps on the take-up roll and imparting a 2× draw which took out the natural elongation tendency of the yarn. The spinning was so excellent, it spun perfectly without one bad hole for 4 h 76 min and a 1.9 cm thick yarn bobbin was obtained.

The fiber T/E/M was 0.36 gpd/6.3%/11 gpd for the undrawn yarn and 0.60 gpd/44%/16 gpd for the 3× wet drawn yarn.

Example 4

A solution (150 g) was prepared containing 45.0% zein, 31.7% methylene chloride and 21.1% methanol for a 60%/40% methylene chloride/methanol ratio and 2.3% urea as a Chaotropic agent. The solution was prepared at 23° C. in one h.

The solution was spun through a 0.127 mm dia., 15 hole, spinneret at a jet velocity of 2.1 m/min. Maximum achievable SSF was 4.4 and maximum ambient draw ratio was also 4.4 versus a 1.4 without the urea.

Bobbins of yarn were spun at 2.0 SSF and 3.0 draw ratio and immersed in a salt solution containing 3% formaldehyde and 7.6% sodium chloride. After 13 days, the yarn was rewound and air-dried.

The air-dried yarn went over a feed roll at 2 m/min and was drawn 1.02× by a first draw roll, half submerged in a water bath. The wet yarn was then drawn 2.44× over a hot shoe at 110° C. and wound upon on a Leesona®. The yarn was further hot drawn 1.3× at 210° C. after dipping in water on the feed roll for a total draw of 9.75×. The resulting yarn had a denier of 42 and T/E/M of 2.05 gpd/10%/58 gpd.

Example 5

A solution (1,196 g) was prepared containing 48.2% zein, 28.9% methylene chloride and 19.3% methanol for a 60%/40% solvent ratio, 1.1% polyethylene glycol (200 molecular weight) and 2.6% water.

Using a 0.127 mm dia., 40 hole, spinneret, yarn was spun at a SSF of 2 with take-up roll at 7 m/min. and wound without draw on a bobbin on a Leesona®. The 1,273 denier yarn had T/E/M of 0.36 gpd/6.3%/11 gpd.

The yarn was immersed in a salt solution comprising formaldehyde for 2 days and air-dried. Then the yarn was taken up by a feed roll at 2.0 m/min, over to a first draw roll also at 2.0 m/min but half submerged in a water bath and then drawn 3.5× over a 110° C. hot shoe. The yarn denier at this point was 315 with T/E/M of 1.56 gpd/20%/23 gpd. This was followed by immersing in the salt solution for 2.5 days and air-dried. The yarn was then taken up at 2.0 m/min by a feed roll half submerged in 60% acetone in water and drawn 1.3× over a 210° C. hot shoe for a total draw of 4.44×. The final yarn had a denier of 258 and T/E/M of 1.88 gpd/10%/22 gpd.

What is claimed is:

1. A process for the dry spinning of zein fiber from solution by dissolving zein in a solvent to form a solution, extruding said solution through a spinneret, and evaporating said solvent to form said zein fiber, wherein the improvement comprises, using as a solvent a first component whose boiling point is about 0° C. to 50° C., and optionally a second component whose boiling point is greater than 50° C., provided that:

a starting weight fraction of zein in said solution is about 0.40 to about 0.60, based on the total amount of solvent and zein in said solution; and a weight fraction of said first component in said solution is $$S \geqq 1 - \frac{Z}{0.675}$$

wherein S is a starting weight fraction of said first component in said solution, and Z is said starting weight fraction of zein in said solution.

2. The process as recited in claim 1 wherein said boiling point for said first component is about 5° C. to about 45° C.

3. The process as recited in claim 1 wherein said weight fraction of said first component is $$S \geqq 1 - \frac{Z}{0.700}.$$

4. The process as recited in claim 1 wherein said first component of the solvent system is one or more of methylene chloride, acetaldehyde, ethylamine, furan, propylene oxide, ethyl mercaptan, methyl iodide, or propionaldehyde.

5. The process as recited in claim 1 wherein said first component of the solvent system is methylene chloride or acetaldehyde.

6. The process as recited in claim 1 wherein said first component of the solvent system is methylene chloride.

7. The process as recited in claim 1 wherein said second component is one or more of methanol, ethanol, acetyl chloride, water, diethylamine, acetone or hexafluoroisopropanol.

8. The process as recited in claim 1 wherein said second component is one or more of water, methanol or ethanol.

9. The process as recited in claim 1 wherein said second component is methanol or ethanol.

10. The process as recited in claim 1 wherein said first component is methylene chloride or acetaldehyde and said second component is methanol or ethanol.

11. The process as recited in claim 1 wherein said first component is methylene chloride and said second component is ethanol or methanol.

12. The process as recited in claim 1 wherein said first component is methylene chloride and said second component is methanol and a weight ratio of said first component to said second component is about 1.5:1.

* * * * *